US005421796A

United States Patent [19]

Jones et al.

[11] Patent Number: 5,421,796

[45] Date of Patent: Jun. 6, 1995

[54] TRICEPS EXERCISE MACHINE

[75] Inventors: Arthur A. Jones, Ocala; Philip Sencil, Anthony, both of Fla.

[73] Assignee: MedX Corporation, Ocala, Fla.

[21] Appl. No.: 194,460

[22] Filed: Feb. 8, 1994

Related U.S. Application Data

[63] Continuation-in-part of Ser. No. 20,807, Feb. 22, 1993, Pat. No. 5,342,270, and a continuation-in-part of Ser. No. 947,284, Sep. 15, 1992, and a continuation-in-part of Ser. No. 921,112, Jul. 29, 1992, Pat. No. 5,338,274, which is a continuation-in-part of Ser. No. 909,658, Jul. 7, 1992, Pat. No. 5,256,125.

[51] Int. Cl.[6] ..... A63B 21/062

[52] U.S. Cl. ..... 482/100; 482/98; 482/134; 482/137

[58] Field of Search ..... 482/133, 134, 135, 136, 482/137, 98, 100

[56] References Cited

U.S. PATENT DOCUMENTS

| | | | |
|---|---|---|---|
| 3,708,166 | 1/1973 | Annas | 482/137 |
| 4,563,003 | 1/1986 | Bugallo et al. | 482/137 |
| 4,775,150 | 10/1988 | Graham | 482/134 |
| 5,056,779 | 10/1991 | Webb | 482/137 |
| 5,102,121 | 4/1992 | Solow et al. | 482/137 |

FOREIGN PATENT DOCUMENTS

| | | | |
|---|---|---|---|
| 2223686 | 4/1990 | United Kingdom | 482/137 |

*Primary Examiner*—Richard J. Apley
*Assistant Examiner*—Lynne A. Reichard
*Attorney, Agent, or Firm*—William E. Mouzavires

[57] ABSTRACT

A triceps exercise machine has a movement arm pivotable about a horizontal axis against the resistance of a weight stack. The machine includes a vertically adjustable seat, a shoulder restraint, and adjustable handgrips secured to the movement arm, all of which position the elbows of the user in general alignment with the axis of rotation of the movement arm. In the start position the arms are fully folded and positioned close to the user's sides. The user then proceeds to force the handles downwardly until the arms are fully extended. Movement of the movement arm is transmitted to the weight stack by a cam fixed to the movement arm and a cam follower which is connected to the bottom of a weight stack pin by a linkage mechanism.

22 Claims, 5 Drawing Sheets 35
57
45
87
53
68
51
54
52
63
55
47
33
40
14
7
12
21
19
16
5

TRICEPS EXERCISE MACHINE

RELATED APPLICATIONS

This application is a continuation in part of U.S. applications of Arthur Jones which are as follows: Ser. No. 08/020,807, filed Feb. 2, 1993, now U.S. Pat. No. 5,342,270; Ser. No. 07/947,284, filed Sep. 15, 1992; and Ser. No. 07/921,112, filed Jul. 29, 1992, now U.S. Pat. No. 5,338,274, which in turn is a continuation in part of application 909,658, filed Jul. 7, 1992, now U.S. Pat. No. 5,256,125. The disclosures of the aforementioned applications as are hereby incorporated by reference into the subject application as part hereof.

BACKGROUND OF INVENTION

The present invention generally relates to machines for exercising the triceps muscles. Numerous machines exist and have been known in the prior art for exercising the aforementioned parts of the human body. Such machines commonly utilize some sort of a movement arm which is moved by the body upon exertion of the muscles to be exercised and against a resistance, typically a weight stack. Commonly, the movement arm is connected to the weight stack by an overhead cable and pulley system which increases the height of the machine and also introduces a certain amount of friction in the transmission of the drive thereby reducing efficiency. It is also common for the exerciser, because of the construction of the machine, to start the exercise with the arms in a half way extended position and hence a full range of motion is not permitted by these machines. Many "free" weight tricep machines also have the same flaw in that due to the starting position of the user a full range of motion for the exercise is impossible. The cable and pulley or free weight tricep exercise machines also have the drawback that, while exercising, the upper torso of the exerciser is free to move which significantly reduces the efficiency as other muscle groups besides the triceps are free to contribute to the exercise.

OBJECTS OF THE PRESENT INVENTION

An object of the present invention is to provide a triceps exercise machine that efficiently exercises the triceps.

A further object of the present invention is to provide a novel and improved triceps exercise machine which allows for a full range of exercise motion.

Another object of the present invention is to provide a novel and improved triceps exercise machine which excludes the use of certain muscle groups so as not to interfere or affect the exercise of the triceps.

Still another object is to provide an exercise machine having a novel and improved restraint for the shoulders of the exerciser.

A further object of the present invention is to provide a novel and improved triceps exercise machine which utilizes a weight stack for resistance to the movement arm but which eliminates the need of an overhead cable and pulley system for transmitting the drive from the movement arm to the weight stack. Included herein is such a machine having a novel and improved transmission for transmitting movement between the movement arm and the weight stack.

A still further object of the present invention is to provide a novel and improved exercise machine which will achieve the above objects in a safe and effective manner.

SUMMARY OF INVENTION

In accordance with a preferred embodiment of the present invention, a subject is seated with his torso against a backrest. The machine has a movement arm that is pivotable about a generally horizontal axis against the resistance of a weight stack. The preferred embodiment also has a vertically adjustable seat, a shoulder restraint, and adjustable handgrips secured to the movement arm. After the user is seated adjustments are made to position the elbows of the user in general alignment with the axis of rotation of the movement arm. In the start position the arms are fully folded and positioned close to the user's side. The user then proceeds to force the handles downwardly until the arms are fully extended. Movement of the movement arm is transmitted to the weight stack by a cam and cam-follower and a linkage connected to a lower portion of the stack pin of the weight stack. During the exercise the shoulders are prevented from moving upwardly by the shoulder restraint which preferably is pivotably connected to the frame of the machine and has a mechanism for releasably holding the restraint in operative position.

DRAWINGS

Other objects and advantages of the present invention will become more apparent from the following more detailed description taken in conjunction with the drawings in which.

DETAILED DESCRIPTION

Figure 1:
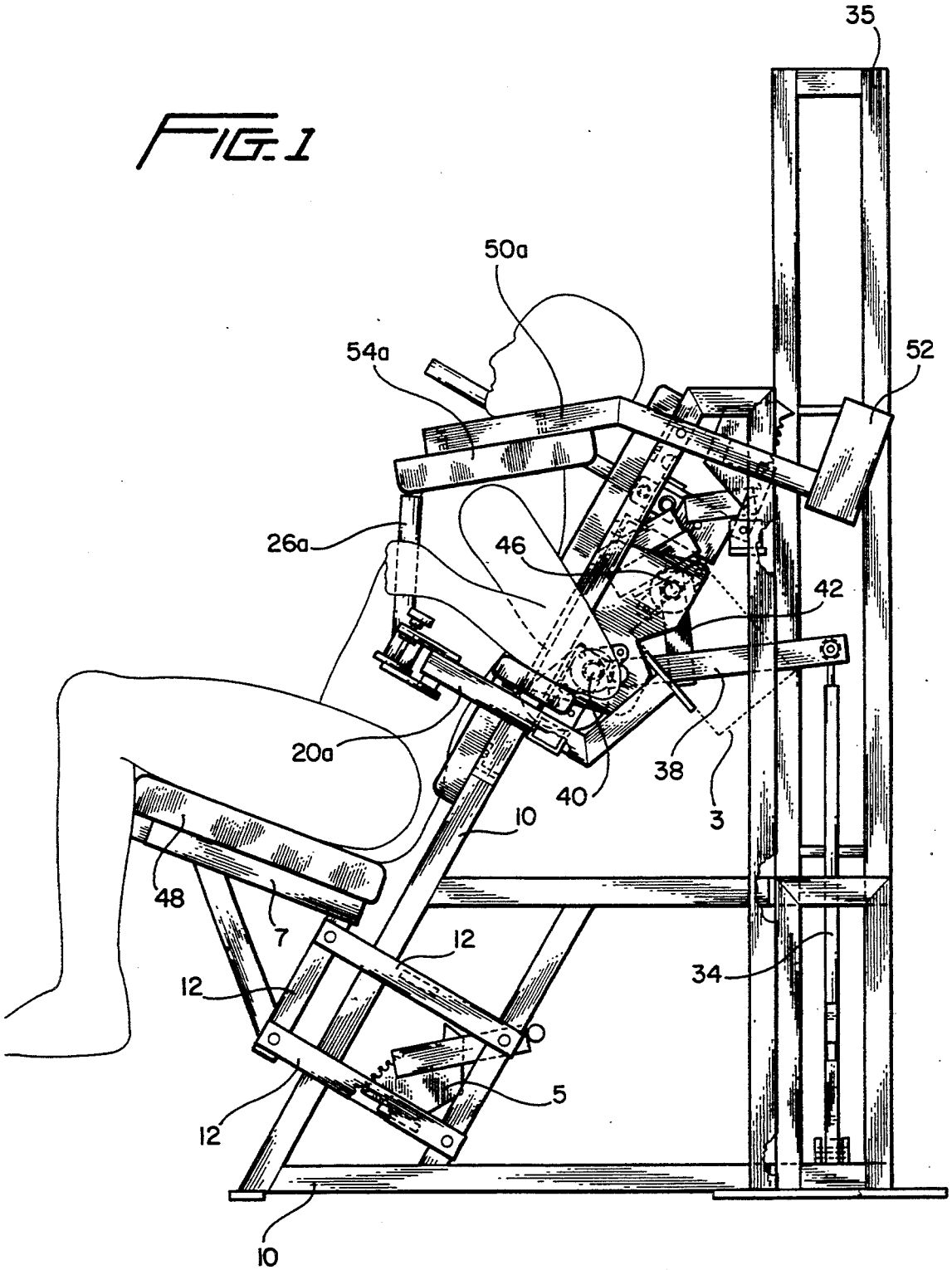
FIG. 1 is a side elevational view of a tricep exercising machine constituting a preferred embodiment of the present invention.
Figure 2:
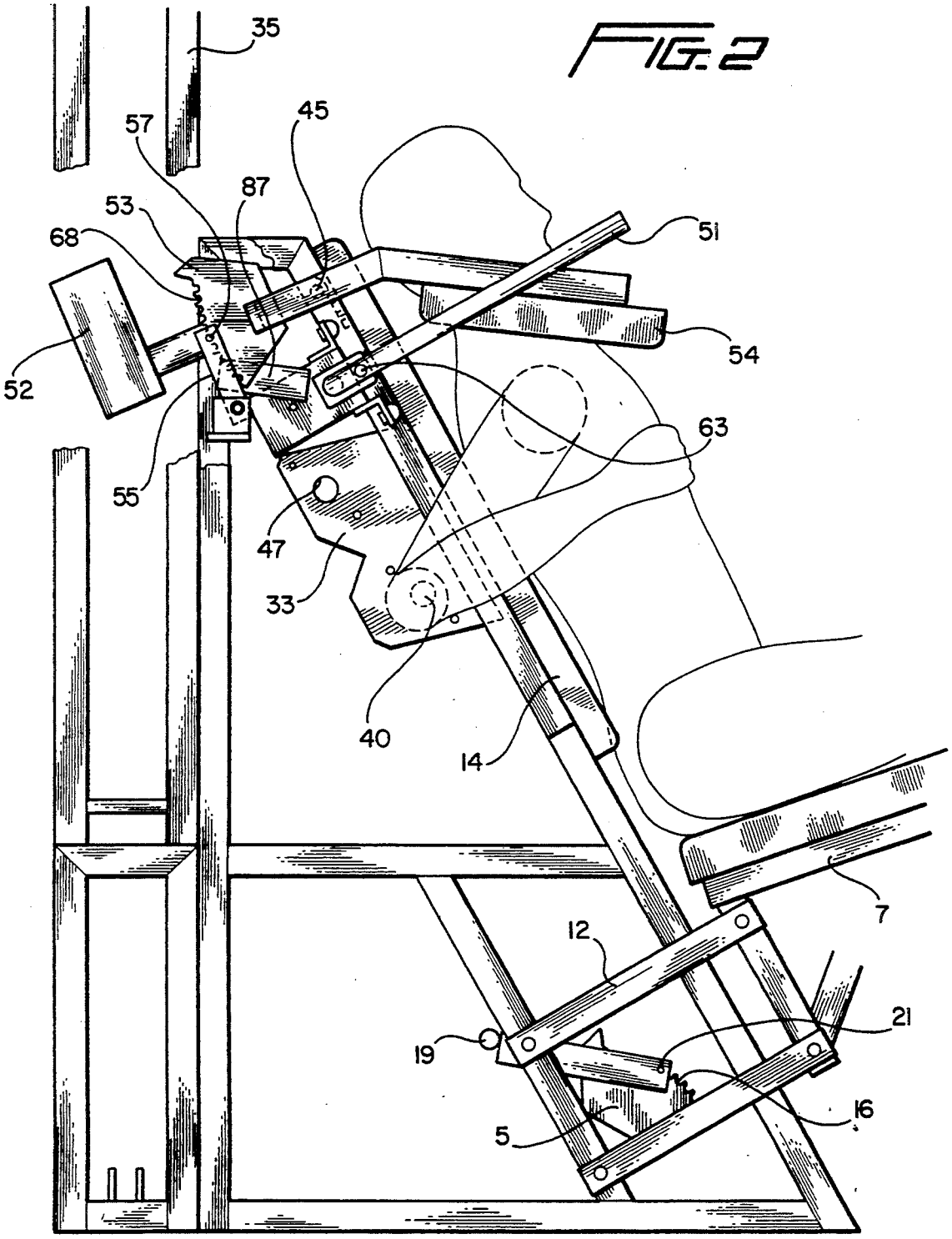
FIG. 2 is a side elevational view of the machine with certain parts removed for clarity.
Figure 3:
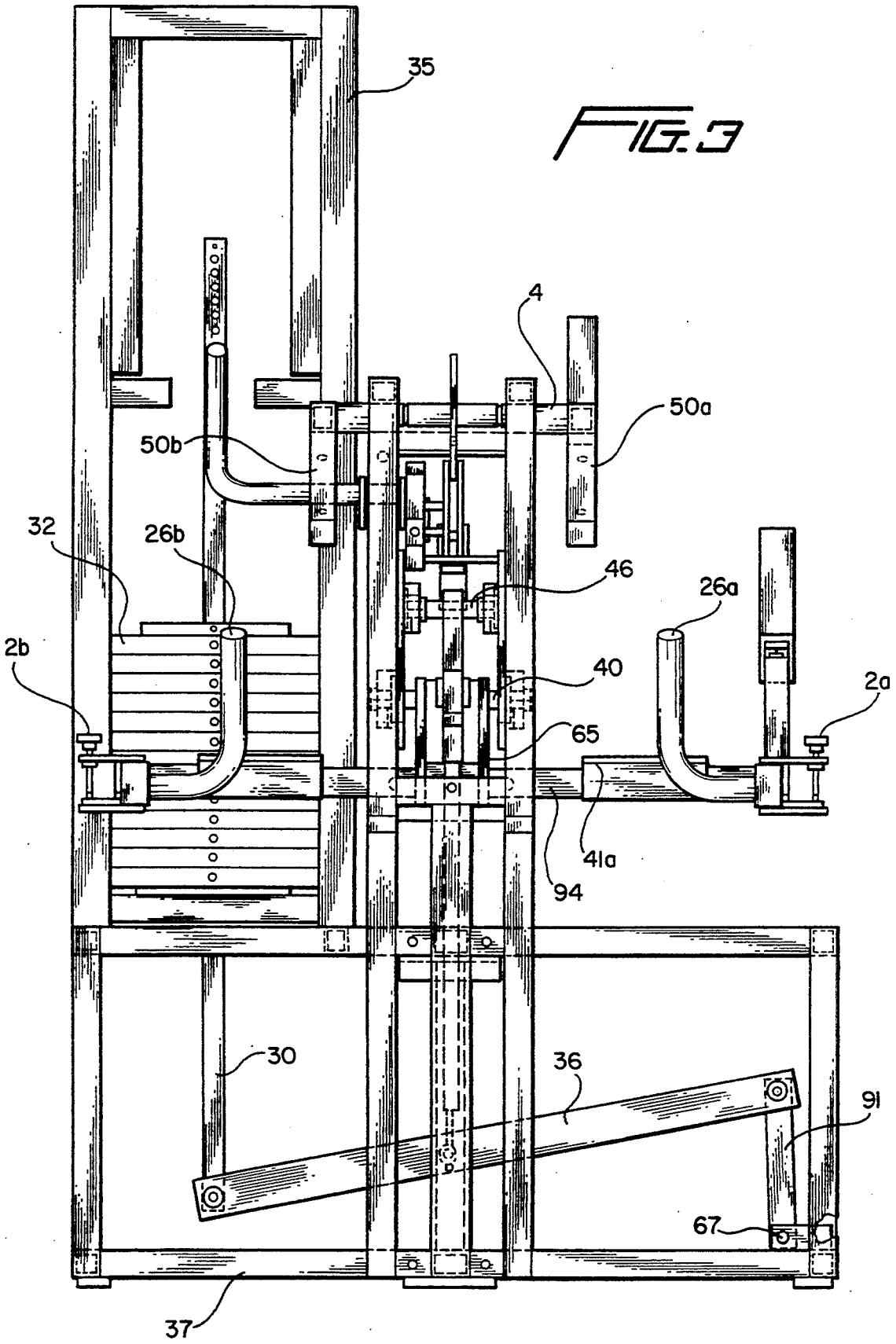
FIG. 3 is a front elevational view of the machine.

Referring now to the drawings in detail, there is shown for illustrative purposes only in FIGS. 1 through 5, a machine embodying the present invention and which may be termed a "triceps" exercise machine for exercising groups of muscles in the upper arms, mainly the triceps. In the preferred embodiment shown, the machine includes a front frame generally designated 10 (in FIG. 1) with a horizontal rectangular frame 37 mounted behind it as shown in FIG. 3. Mounted on the left side of frame 37 when viewed from the front of the machine, is a vertical rectangular frame 35 which houses a resistance weight stack 32 of the machine. In the preferred embodiment these frames are made of elongated rails of tubular stock of high strength metallic material, however any other suitable material may be utilized as long as it provides the necessary strength and weight. In addition, it is preferred that the resistance weight stack be a compound weight stack as disclosed in U.S. Pat. No. 4,834,365 whose disclosure is hereby incorporated by reference as part hereof.

Referring to FIG. 1, primary frame 10 includes a seat generally designated 48 mounted to it by means of a parallelogram linkage generally designated 12. The pad of seat 48 is fixed to a base 7 which in turn is mounted to the parallelogram linkage 12. As shown in FIG. 2 for vertical adjustment of the seat 48 there is provided at the rear of parallelogram linkage 12 a lever actuating handle 19 which when raised to an upright position allows for placement of a seat-adjustment pin 21 into one of a plurality of recesses 16 located on a plate 5 fixed to the frame. A backrest 14 is fixed to a frame 10 and lies approximately 45° to the horizontal.

Figure 4:
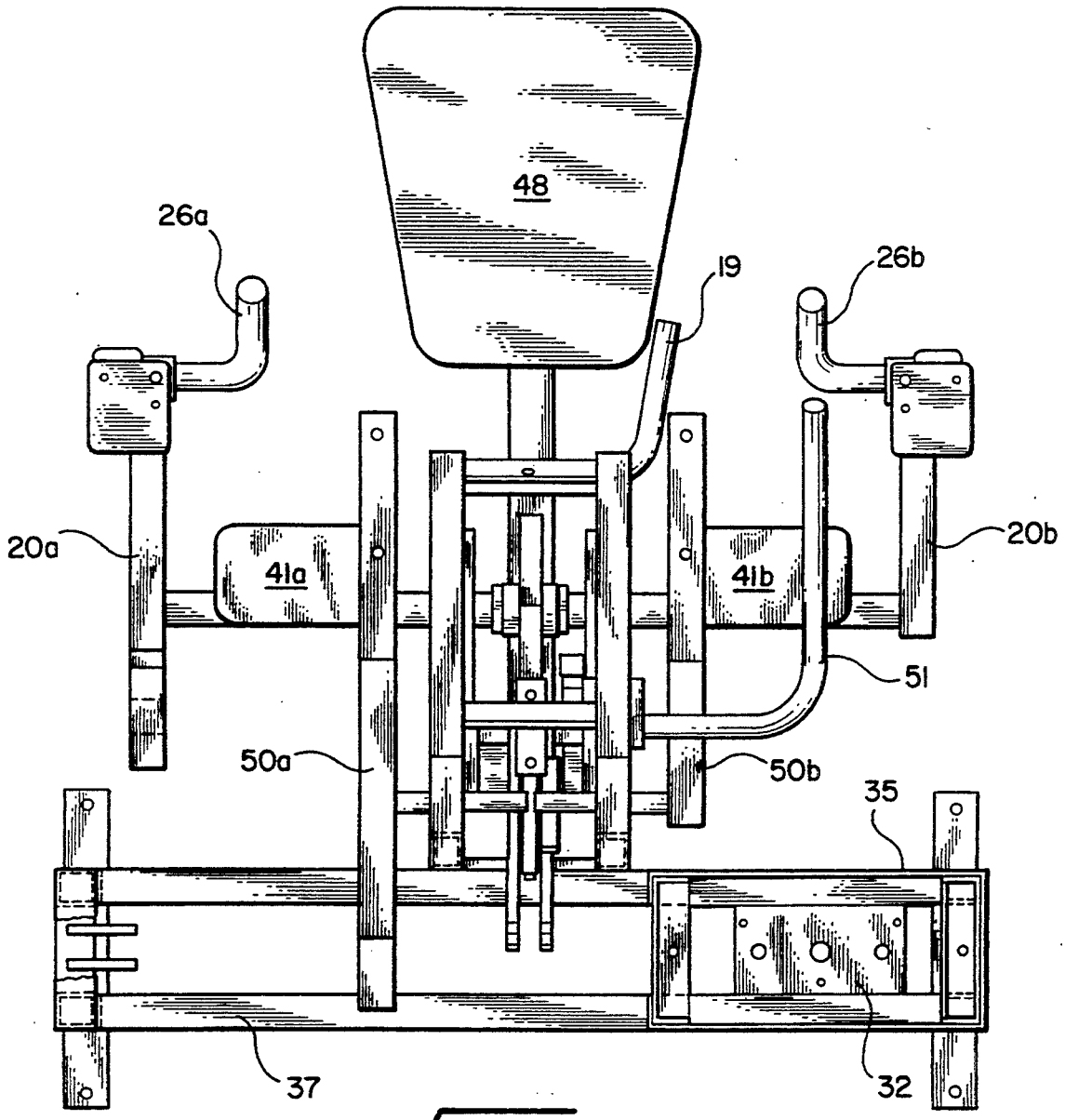
FIG. 4 is a plan view of the machine.

The exercise is performed by moving a movement arm 20*a*, 94, 20*b* against a resistance provided by the weight stack 32 supported in frame 35. As best shown in FIG. 4, the movement arm includes laterally-spaced side portions 20*a* and 20*b* joined by a cross portion in the form of a bar 94 which is mounted for rotation about a horizontal axis provided by shaft 40 (FIG. 3). The latter is mounted in plates 33 (FIG. 2) fixed to frame portion 10. In the embodiment shown, plates 65 are fixed to cross piece 94 and extend upwardly where they are mounted about shaft 40 as best shown in FIG. 3.

Referring to FIG. 4, located at the front of movement arms 20*a* and 20*b* are adjustable hand grips 26*a* and 26*b*. These hand grips 26 are adjusted longitudinally by loosening adjustment knobs 2*a* and 2*b* (shown in FIG. 3) associated with the hand grips and extending or retracting the handle grips to suit the user's forearm size, and then re-tightening adjustment knobs 2*a* and 2*b*. Fixed to the top surface of cross bar 94 of the movement arm, as can be seen in FIG. 4, are elbow pads 41*a* and 41*b*. Pads 41*a* and 41*b* are positioned to support the user's elbow joints in alignment with the axes of rotation of the movement arm. The movement arm including the handles 26*a*, 26*b* and the elbow pads 41*a*, 41*b* and the location of the axis of rotation at 40 are designed such that the user can position the elbow joints in general alignment with the axis of rotation 40 of the movement arm while the arms are fully bent or folded against each other as shown in FIGS. 1 and 2. This is the start position of the exercise which may thus proceed by unfolding and extending the arms downwardly at each side until they are fully extended. Maximum range of exercise of the triceps is achieved in this manner.

Figure 5:
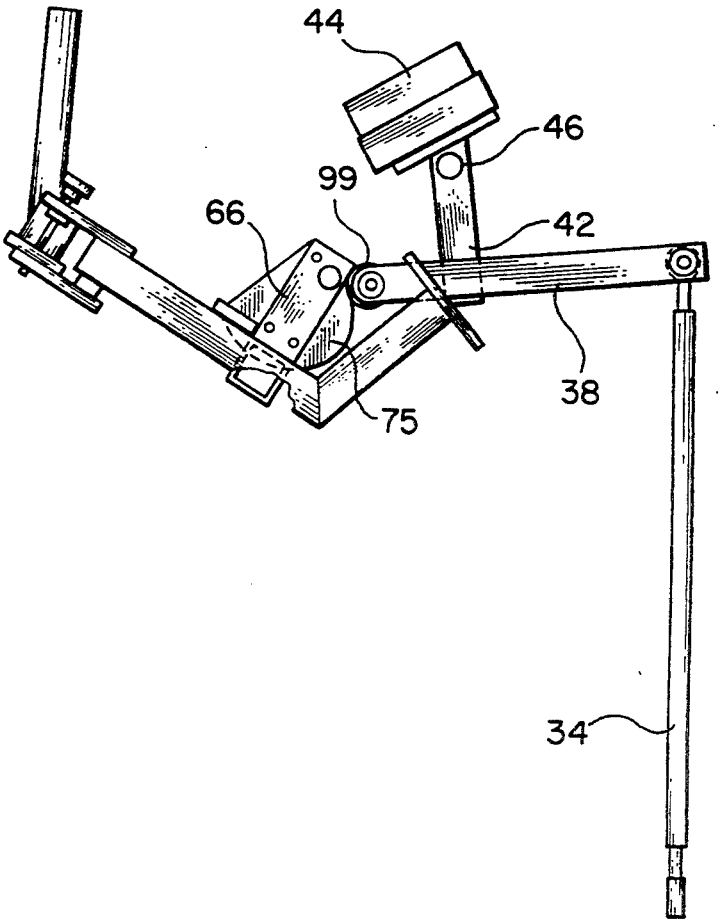
FIG. 5 is a side elevational view of parts of a transmission included in the machine while in an exercise-start position.
Figure 6:
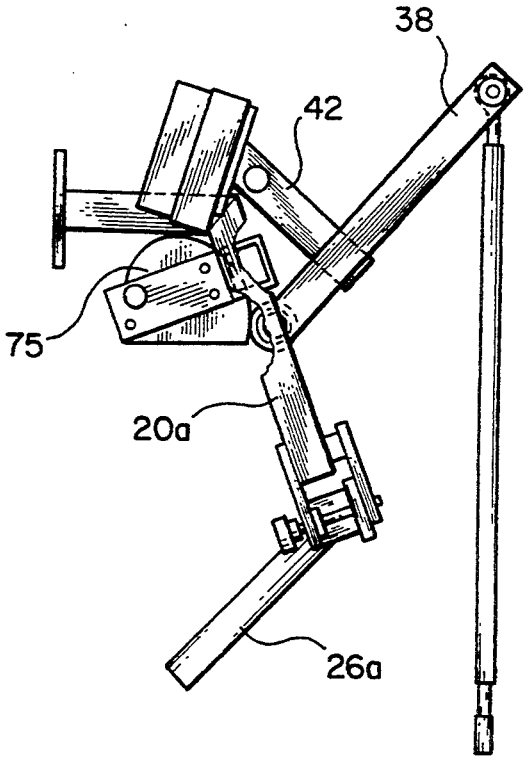
FIG. 6 is a view generally similar to FIG. 5 but with the parts shown in an exercise-finished position.

Movement of the movement arm 20*a*, 20*b*, is transmitted to the resistance weight stack 32 to raise one or more weights attached to stack pin 30, is achieved by a unique transmission mechanism including a cam 75 fixed to cross portion 94 of the movement arm. Referring to FIGS. 5 and 6, in the specific embodiment shown, a bracket 66 fixed to the cross portion 94 is used to mount the cam 75 in the center of the movement arm. Cooperating with the cam 75 is a cam follower 99 on the end of a cam follower bar 38. The latter is mounted through an arm 42 fixed thereto for rotation about a shaft 46 which is journalled in apertures 47 in mounting plates 33 shown in FIG. 2. Preferably a counterweight 44 is fixed to arm 46 to counterbalance the follower bar 38. The far end of follower bar 38 is pivotally connected to the top of a vertical drive member 34.

Referring now to FIG. 3, the lower end of drive member 34 is pivotally connected to a main drive lever 36 one end of which is pivotally connected to the bottom of weight stack pin 30. The other end of main drive lever 36 is pivotally connected to a mounting link 91 which in turn is pivotally mounted to the frame 37 at pivot 67. It will be seen that when the movement arm 20*a*, 20*b* is pivoted downwardly or counterclockwise as viewed in FIG. 1, cam 75 will rotate follower bar 38 counterclockwise (as viewed in FIG. 5) from the position shown in FIG. 5 to the position shown in FIG. 6. This will raise drive member 34 which in turn will pivot main lever 36 clockwise as viewed in FIG. 3 to raise the weight stack pin 30 and the selected resistance weights connected to the pin. When the exerciser relieves pressure on the movement arm 20*a*, 20*b*, the latter will return to the starting position generally shown in FIGS. 1 and 5.

In order to prevent the user's torso from rising as the movement arm is moved downwardly by the user's arms, a shoulder restraint is provided to engage the top of the shoulders during the exercise. In the preferred embodiment shown the should restraint includes shoulder pads 54*a* and 54*b* fixed to shoulder rocker bars 50*a* and 50*b* which in turn are pivotably mounted to frame 10 by a cross bar 4 interconnecting of rocker bars 50*a*, 50*b* (see FIGS. 1 and 3). Cross bar 4 is pivotally mounted at 45 to the frame 10 as shown in FIGS. 1 and 2. At the rear of shoulder pad rocker bar 50*a* is mounted a weight 52 biasing the shoulder restraint to a raised position. Referring to FIG. 2 in order to maintain the restraint in a lowered operative position against the user's shoulders, a releasable latch mechanism is provided including a latch plate 53 fixed to the frame and having a series of recesses 68 for receiving a latch pin 57. As can be seen in FIG. 2, latch pin 57 is on a link 55 which is actuated by a link 87 through means of a handle bar 51 pivotally mounted at 63 to the frame 10.

In use of the machine, the user adjusts the seat 48 and handles 26*a*, 26*b* until he can position the elbows fully folded with the elbow joints generally aligned with the axis 40 of rotation of the movement arm as shown in FIGS. 1 and 2. The shoulder restraint 54*a*, 54*b* is then lowered to engage the tops of the shoulders as shown in FIGS. 1 and 2. The shoulder restraint is then locked in position. The user begins the exercise by unfolding the arms downwardly and continues slowly and smoothly until the arms are fully extended. During such movement, cam 75 on the movement arm drives the follower bar 38 and through the linkage 34, 36 raises one or more resistance weights 32. Also the shoulder restraint 54*a*, 54*b* prevents the torso from rising as the exerciser is lowering the arms against the resistance. Thus the exerciser is held in the proper position for maximum efficiency of the exercise. From the fully extended position the exerciser then relieves pressure on the movement arm which returns by gravity to the start position whereupon the exercise is repeated. In the preferred embodiment a counterweight shown in dotted lines at 3 in FIG. 1 is secured to the rear end of movement arm portion 20*a* to balance the movement arm about its axis of rotation 40.

Although a preferred embodiment of the machine of the present invention has been shown and described above, the scope of the invention is not limited to such specific form but rather is defined in the claims apended hereto and any continuation applications that may be subsequently filed.

We claim:

1. An exercise machine for exercising the triceps comprising in combination, a movement arm rotatable about a generally horizontal axis and a restraining means for positioning an exerciser with his elbows generally aligned with the axis of rotation of the movement arm, said movement arm being movable by the exerciser's arms between a start position with the movement arm extending generally forwardly with the arms bent and a finish position with the movement arm extending generally downwardly with the arms fully extended downwardly, said restraining means including a shoulder restraint preventing upward movement of an exerciser's shoulders.

2. The exercise machine defined in claim 1 wherein said restraining means includes an adjustable handle on the movement arm to be grasped by the exerciser for adjusting the length of the movement arm for aligning the elbows with the axis of rotation.

3. The exercise machine defined in claim 1 further including a horizontal seat for receiving the exerciser.

4. The exercise machine defined in claim 1 including a resistance weight stack and transmission means between the weight stack and movement arm; said transmission means including a cam fixed to the movement arm and a follower link having a follower engageable with the cam and connected to the weight stack to transmit movement between the movement arm and the weight stack.

5. The exercise machine defined in claim 4 wherein said transmission means further includes a main lever connected to a weight stack pin and a mounting link mounting the main lever to a fixed support.

6. The exercise machine defined in claim 4 including a counter-weight fixed to the movement arm, a counterweight fixed to the follower link, and a counterweight fixed to the shoulder restraint.

7. The exercise machine defined in claim 1 wherein said restraining means is mounted for movement about a generally horizontal axis into and out of engagement with the top of the exerciser's shoulder.

8. The exercise machine defined in claim 7 including a means releasably holding the shoulder restraint in engagement with the exercisers shoulders.

9. An exercise machine comprising in combination, a movement arm rotatable by an exerciser about a generally horizontal axis, a weight stack providing a resistance to movement of the movement arm, transmission means between the weight stack and movement arm, said transmission means including a cam fixed to the movement arm for rotation therewith, a follower link having a follower engageable with the cam, a main lever connected to a lower portion of a weight stack pin included in the weight stack to raise the pin when the movement arm is moved by the exerciser, a drive member extending downwardly and interconnecting the follower link and the main lever, a mounting link mounting the main lever to a fixed support, and a counterweight fixed to the movement arm, and a counterweight fixed to the follower link.

10. An exercise machine for exercising the triceps comprising in combination, a fixed support, a generally horizontally-extending seat for seating an exerciser with the exerciser's torso extending generally upwardly from the seat, a movement arm mounted on said support for movement about a generally horizontal axis, a restraining means for preventing upward movement of an exerciser's shoulders, means mounting said restraining means for movement into and out of engagement with the shoulders between an upper position located above the shoulder and a lower position engaging the shoulders.

11. The exercise machine defined in claim 10 wherein said restraining means is pivotably mounted to the support.

12. The exercise machine defined in claim 11 including a latch mechanism for holding said restraining mechanism in a position engaged with the shoulders.

13. The exercise machine defined in claim 12 wherein said restraining means has a counterweight.

14. The exercise machine defined in claim 10 including a latch mechanism for holding said restraining means in a position engaged with the shoulders.

15. An exercise machine which includes a support frame, a movement arm pivotably mounted to the frame and rotatable about a generally horizontal axis, a weight stack, and a transmission means which includes a cam fixed to the movement arm, a follower pivotably connected to the frame and engageable with the cam, and a drive member operatively connected between the follower and the weight stack, and a counterweight connected to the cam follower.

16. The exercise machine defined in claim 15 with a main lever interconnecting the weight stack and the drive member.

17. The exercise machine defined in claim 16 with a link pivotably connected to the support frame and the main lever.

18. The exercise machine defined in claim 17 with means for exercising the triceps.

19. The exercise machine defined in claim 15 with means for exercising the triceps.

20. The exercise machine defined in claim 15 further including a counterweight connected to the movement arm.

21. An exercise machine for exercising the triceps comprising in combination, a movement arm rotatable about a generally horizontal axis, a resistance weight stack to oppose movement of the movement arm in one direction, transmission means between the weight stack and the movement arm to transmit forces between the movement arm and the weight stack, said transmission means including a cam fixed to the movement arm and a follower link having a follower engageable with the cam, restraining means for preventing upward movement of an exerciser's shoulders, a counterweight fixed to the movement arm, a counterweight fixed to the follower link, and a counterweight fixed to the restraining means.

22. An exercise machine for exercising the triceps comprising in combination, a fixed support, a movement arm mounted on said support for movement about a generally horizontal axis, a restraining means for preventing upward movement of an exerciser's shoulders, means mounting said restraining means for movement into and out of engagement with the shoulders, and a latch mechanism for holding said restraining means in a position engaged with the shoulders.

* * * * *